US005650687A

United States Patent [19]

van den Bogaert

[11] Patent Number: 5,650,687

[45] Date of Patent: Jul. 22, 1997

[54] GROUND ELECTRODES FOR IGNITION PLUGS

[76] Inventor: Bernard van den Bogaert, Molenbeekstraat 22, B-1745 Opwijk, Belgium

[21] Appl. No.: 537,641

[22] Filed: Oct. 2, 1995

[51] Int. Cl.[6] ..... H01T 13/20

[52] U.S. Cl. ..... 313/141; 313/142

[58] Field of Search ..... 313/141, 142, 313/143; 123/169 EL, 169 R

[56] References Cited

U.S. PATENT DOCUMENTS

| | | | |
|---|---|---|---|
| 1,519,511 | 12/1924 | Schmidt | 313/141 |
| 1,942,242 | 1/1934 | Fitzgerald | 313/141 |
| 1,985,192 | 12/1934 | O'Marra | 313/143 |
| 2,518,844 | 1/1950 | Wetzel | 313/142 |
| 2,845,566 | 7/1958 | Regar | 313/142 |
| 4,401,915 | 8/1983 | Kashiwara et al. | 313/142 |
| 4,484,101 | 11/1984 | Ibbott | 313/142 |
| 4,970,426 | 11/1990 | Bronchart | 313/141 |
| 5,047,685 | 9/1991 | Nowacki et al. | 313/141 |
| 5,373,214 | 12/1994 | McCready | 313/141 |

FOREIGN PATENT DOCUMENTS

| | | | |
|---|---|---|---|
| 337889 | 11/1930 | United Kingdom . | |
| 2027797 | 5/1979 | United Kingdom . | |
| 2189545 | 10/1987 | United Kingdom | 313/141 |

*Primary Examiner*—Nimeshkumar Patel
*Attorney, Agent, or Firm*—Leonard Bloom

[57] ABSTRACT

A spark plug for internal combustion engines is provided with a ground electrode in the form of a metallic bar the end of which is facing the central electrode at an appropriate distance. The cross section of the bar is triangular or ogival with a rounded tip directed outwardly. The bar terminates in an outwardly tapered end face.

13 Claims, 2 Drawing Sheets

GROUND ELECTRODES FOR IGNITION PLUGS

BACKGROUND OF THE INVENTION

The present application relates to an ignition plug for an internal combustion engine, more particularly to a ground electrode which is a part of such an ignition plug.

Generally, the ground electrode is in the form of a metallic bar extending from one side of the annular component forming the threaded shell of the plug, the bar being bent such to be L-shaped towards the axis of the plug and located within an appropriate distance above the central electrode which is generally concentric with the said axis. This bar is of rectangular cross section. The electrode is connected to the ground through the threaded shell which, in use, is in contact with the engine.

It is known that one can vary the form and configuration of the ground electrode in order to obtain an effect on the electrical spark and/or the ignition and/or the movement and turbulence of gases in the cylinder of an engine.

Ground electrodes of complicated forms and configurations, e.g. annular around the central electrode, or with openings, grooves, slots or in the form of a fork, have been disclosed in U.S. Pat. No. 4,401,915 and French patent application No 2,440,100. In PCT patent application WO81/01918 there is disclosed a spark plug with several L-shaped electrodes which have been twisted so to give them the form of blades of a propellor. This configuration would afford favorable swirling movements of the flame front.

U.S. Pat. No. 2,845,566 discloses a spark plug with a flat, ribbon-shaped electrode downwardly and inwardly twisted at an angle of slightly less than ninety degrees. The ribbon edge terminates in a sharp nose and lies within the axial projection of the central electrode. A minimum baffle or obstruction of the flow of the gases in both direction is claimed. The spark plug is claimed to be more erosion-resistant than classical spark plugs.

It is also known to improve the resistance to erosion of the ground electrode by giving a different configuration to the cross section of the ground electrode. U.S. Pat. No. 4,970,426 (Bronchart) discloses a ground electrode which has a cross section such that the surface of the ground electrode which is located nearest to the bottom of the central electrode is larger than the surface of the ground electrode which is located farthest away from said bottom end of the central electrode, the spark being viewed with the electrodes pointing downward. In one embodiment the smaller surface is reduced to a line, the cross section being then triangular. It is also disclosed that the lateral sides of the triangular cross section may be curved.

SUMMARY OF THE INVENTION

The object of the present invention is to provide an improved ground electrode for internal combustion engine characterised in that the cross section of a metallic bar, forming the active sparking segment of the ground electrode, shows an aerodynamic and lean profile relative to the end of the cylinder opposite to the spark plug.

It has been found in a surprising way that the above particular cross-sectional profile of the ground electrode according to the invention allows a far better performance of the engine compared to classical electrodes regarding a variety of parameters (pollution, consumption, carbon deposit, soft running, yield, power, temperature of the plug).

Particularly surprising advantages have been observed in connection with the starting of the engine and the use of poor fuel-air mixture (lambda above 1).

More particularly, the electrode according to the present invention improves the performance of the engine at slow engine speed (in terms of rotations per minute) and low opening of the throttle valve.

DETAILED DESCRIPTION OF THE INVENTION

According to a particular embodiment, preferred on the basis of its simplicity, the ground electrode is located in a classical way at an appropriate distance opposite the central electrode, the bar however being designed such as to be of substantially triangular cross section with a rounded angle opposite the side of the triangle closest to the central electrode, one of the lateral face of the bar, which is in the form of a prismatic member, being substantially perpendicular to the axis of the spark plug.

According to another embodiment the cross section of the bar or equivalent element used as ground electrode may exhibit an ogival profile, the top being also rounded.

According to a third embodiment, there is provided a spark plug with a ground electrode in which the horizontal segment of the bar has an outwardly tapered end face. The end face is preferably planar.

According to a preferred embodiment, there is provided a spark plug with the combined features of a substantially triangular cross section and an outwardly tapered end face.

Figure 1:
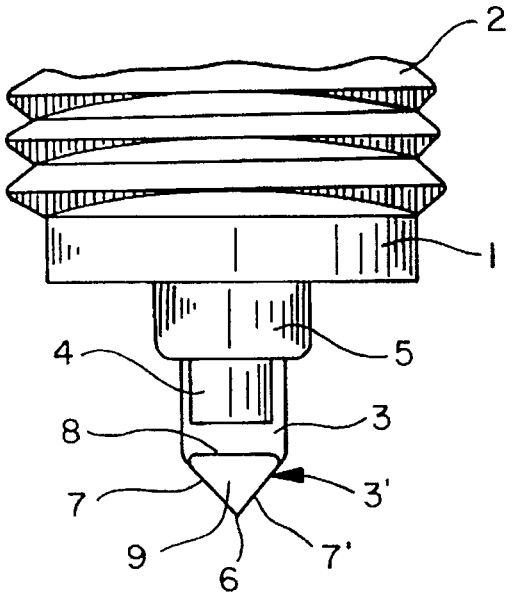
FIG. 1 (PRIOR ART)
FIG. 1 is a partial elevational view of a spark plug with the electrodes having the shape disclosed in Bronchart.

FIG. 1 is a view of the electrodes of a spark plug with the shape disclosed in Bronchart. There is a main tubular body 1, a threaded shell or base 2, a bent ground electrode 3 and 3' and a central electrode 4 encompassed with the isolating material 5. There is a well-defined line 6 separating both side surfaces of the ground electrodes. A surface 8 perpendicular to the longitudinal axis of the spark-plug is facing the central electrode.

Figure 2:
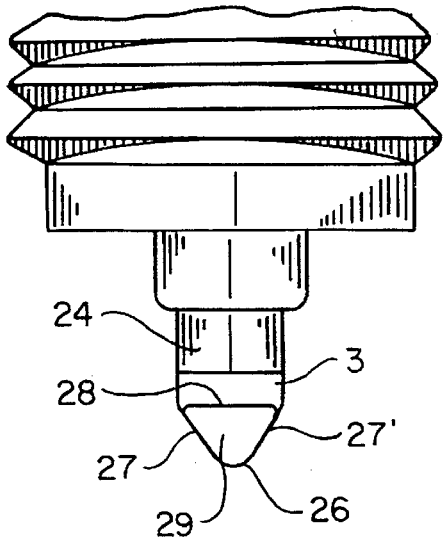
FIG. 2 shows a corresponding view with the improved ground electrode according to one embodiment of the invention.

FIG. 2 shows a corresponding view with the improved ground electrode, having a triangular cross section with a rounded angle at the opposite end 26 of the ground electrode in respect of the central electrode. This view correspond to the embodiment with or without a tapered end face. In contrast to the prior art represented in FIG. 1 the transversal thickness of the central electrode 24 may be equal or larger than the corresponding dimension of the opposite surface of the ground electrode.

Figure 3:
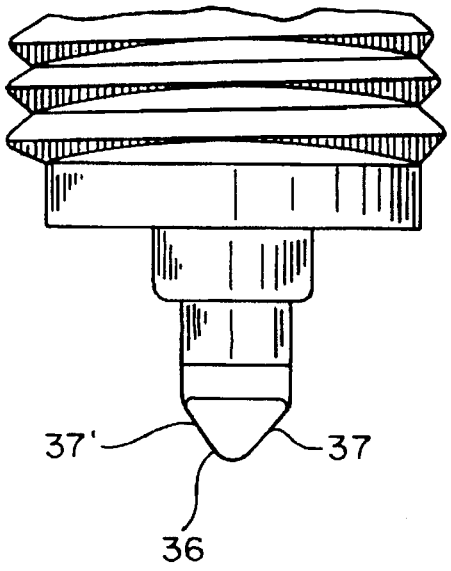
FIG. 3 is a corresponding view according to another embodiment.

FIG. 3 illustrates another embodiment, presently less preferred, wherein the lateral sides 37, 37' of the triangular section are curved so that the overall cross section exhibit an ogival or a paraboloidal shape.

Figure 4:
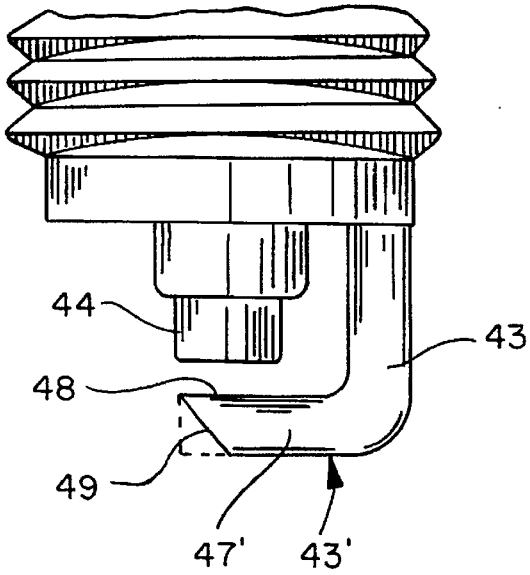
FIG. 4 is a side view of the view corresponding to FIG. 3 or FIG. 4, with an additional feature according to the present invention.

FIG. 4 is a side view corresponding to FIG. 3 or FIG. 4, with an additional feature. The ground electrode bar is shown longitudinally with the main segment 43' being perpendicular to the axis of the spark plug and facing the central electrode 44. According this particular embodiment, the segment 43' of the bar used as electrode shows a chamfered end face 49 more particularly an outwardly tapered free end face. The usual configuration of the end of the bent bar is shown in broken lines.

Figure 5:
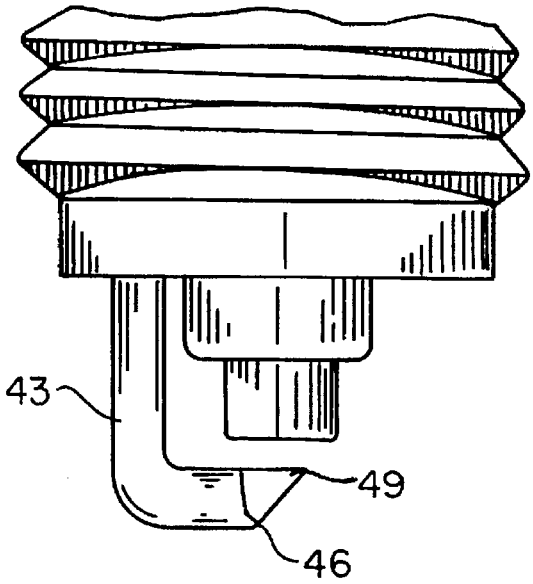
FIG. 5 is a perspective view of a presently preferred embodiment of the invention.

FIG. 5 is view of the spark plug of FIG. 5 embodying a ground electrode with substantially triangular cross section and the outwardly tapered end face 49. The ground electrode is view in perspective with the rounded angle 46.

Figure 6:
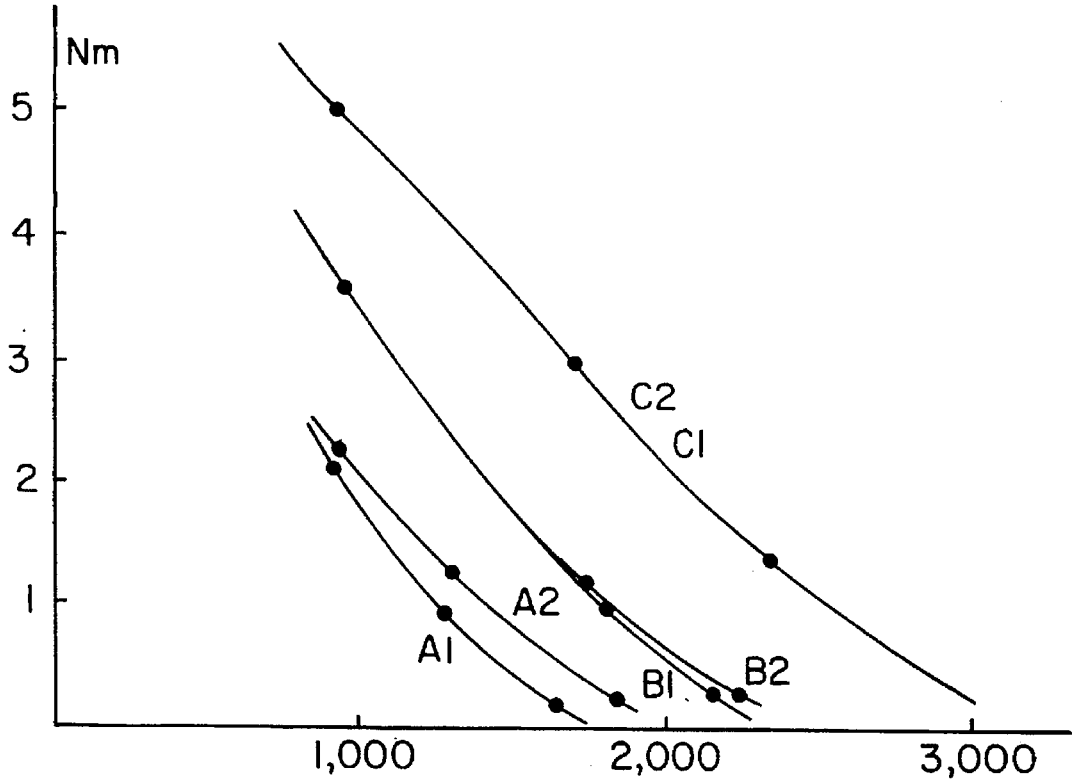
FIG. 6 is a graph showing the improvement provided by a spark plug according to the invention.

FIG. 6 is a graph (couple in Nm versus rotations per minute) illustrating the beneficial effect of the spark plug according to the invention. The results have been obtained using a Simca 1000 engine (1975) of 944 $cm^3$. The comparative experiments show the couples provided by the engine relative to the speed of the engine, for an engine using a spark plug according to FIG. 5 and a classical commercially available spark plug with a rectangular cross section of the ground electrode. The experiments were conducted each time for three positions of the throttle valve, the opening position of the valve increasing for the curves from left to right (A to C).

At slow speed (around 1,500 rpm) the curve A2 obtained with the spark plug of the invention shows a significantly increased couple when compared with the curve A1 obtained with a classical spark plug. The beneficial difference seems to disappear at higher opening of the throttle valve ( partly and totally superposed B1, B2 and C1, C2 respectively).

Obviously the composition and configuration of the electrode of the invention may be varied according to the prior art. The electrode may be a L-shaped bar as illustrated in the figures and above mentioned examples, or it may be shaped according another known configuration.

A spark plug may furthermore, for example, incorporate several electrodes in accordance with the invention.

On the other hand, it is often an advantage that the side member supporting or constituting the non active part of the ground electrode show also an aerodynamic profile relative to the side opposite the explosion, for example a triangular profile as already mentioned. It is more particularly the case for the segment of the bar parallel to the axis of the spark plug and for the bent segment.

It is to be noted that the purpose of the invention is not similar to the one disclosed by Bronchart which is directed to resistance to erosion. Along that line, according to the present invention, it is not a requirement that the ground electrode be larger than the central electrode in order to show the claimed advantage.

The proposed shape would be able to create a laminar flux of gas during the compression phase, at the level and on each side of the element used as a ground electrode.

Without wishing to be bound by an interpretation or a theory regarding the observed effect, one may speculate that the particular shape provided to the electrode according to the invention, allows the flux of gas, during the compression phase, to provoke an advantageous vortex phenomena between the ground electrode and the central electrode. On the other side, during the explosion step, the plug according to the invention would avoid formation of shadow zones where combustion is not completed, such zones being located on the side of the ground electrode opposite the spark.

A spark plug according to the invention, such as the one shown in FIGS. 2 to 4, may be obtained from a commercially available spark plug with a lateral bent bar of rectangular cross section. The cross section of the bar or of a segment thereof may be made triangular or ogival by usual filing.

The invention is not limited to the above mentioned embodiments which may be varied in construction and details.

I claim:

1. A spark plug for an internal combustion engine with an improved ground electrode characterized in that a cross section of the electrode, parallel to the axis of the spark plug, is substantially triangular with at least a rounded angle opposite a side of the triangle closest to a central electrode, said side being substantially perpendicular to the axis of the plug.

2. A spark plug according to claim 1 wherein the ground electrode terminates in a tapered end face facing outwardly in respect to the central electrode.

3. A method to improve the performance of a combustion engine at low opening of the throttle valve which comprises adapting to said engine at least one spark plug according to claim 1.

4. A spark plug for an internal combustion engine with an improved ground electrode characterized in that a cross section of the electrode, parallel t the axis of the spark plug, is substantially of ogival shape with a rounded tip, which is, once adapted to the engine, directed towards the end of a cylinder contained in said engine and associated with said spark plug.

5. A spark plug according to claim 4 wherein the ground electrode terminates in a tapered end face facing outwardly in respect to the central electrode.

6. A method for improving the performance of a combustion engine at low opening of the throttle valve which comprises adapting to said engine at least one spark plug according to claim 4.

7. A ground electrode in a spark which is a side bar extending from the body of the plug, bent so to be L-shaped towards the center in order that one end be located at an appropriate distance from a central electrode which is electrically isolated from said ground electrode, said bar being characterized in that it is of a triangular cross section, with a rounded angle opposite a side closest to the central electrode, a substantially prismatic member so formed opposite the central electrode showing a surface substantially perpendicular to the axis of the spark plug.

8. A ground electrode according to claim 7 characterized in that said bar has a tapered end face facing outwardly in respect to the central electrode.

9. A method for improving the performance of a combustion engine at low opening of the throttle valve which comprises adapting to said engine at least one spark plug according to claim 7.

10. A ground electrode in a spark plug which is a side bar extending from the body of the plug, bent so to be L-shaped towards the center in order that one end be located at an appropriate distance from a central electrode which is electrically isolated from the ground electrode, said bar being a prismatic member forming above the central electrode a surface substantially perpendicular to the axis of the spark plug characterized in that said bar terminates in a tapered end face facing outwardly in respect to the central electrode and lying within the axial prolongation of the central electrode.

11. A method for improving the performance of a combustion engine at low opening of the throttle valve which comprises adapting to said engine at least one spark plug according to claim 10.

12. A ground electrode in a spark plug which is a side bar extending from the body of the plug, bent so to be L-shaped towards the center in order that one end be located at an appropriate distance from a central electrode which is electrically isolated from the central electrode, said bar being characterized in that it is of triangular cross section, with a rounded angle opposite a side of said triangular section closest to the central electrode, a substantially prismatic member so formed opposite the central electrode having a surface substantially perpendicular to the axis of the spark plug, said bar terminating in a tapered end face facing outwardly in respect to the central electrode and lying within the axial prolongation of the central electrode.

13. A method for improving the performance of a combustion engine at low opening of the throttle valve which comprises adapting to said engine at least one spark plug according to claim 12.

* * * * *

UNITED STATES PATENT AND TRADEMARK OFFICE

CERTIFICATE OF CORRECTION

PATENT NO. : 5,650,687
DATED : July 22, 1997
INVENTOR(S) : van den Bogaert

It is certified that error appears in the above-identified patent and that said Letters Patent is hereby corrected as shown below:

On the title page, please add:

--- Related U.S. Application Data:

Continuation-in-part of Ser. No. 08/204,005, March 1, 1994---

Signed and Sealed this

Twentieth Day of July, 1999

*Attest:*

*Attesting Officer*

Q. TODD DICKINSON

*Acting Commissioner of Patents and Trademarks*